US008766877B2

(12) United States Patent
Saito et al.

(10) Patent No.: US 8,766,877 B2
(45) Date of Patent: Jul. 1, 2014

(54) COMMUNICATION SYSTEM IN TRAINS

(75) Inventors: Nao Saito, Hitachi (JP); Setsuo Arita, Hitachiota (JP); Satoru Ito, Hitachinaka (JP); Kazunori Ayabe, Hitachinaka (JP); Yukio Sagawa, Chigasaki (JP)

(73) Assignee: Hitachi, Ltd., Tokyo (JP)

( * ) Notice: Subject to any disclaimer, the term of this patent is extended or adjusted under 35 U.S.C. 154(b) by 1330 days.

(21) Appl. No.: 12/019,048

(22) Filed: Jan. 24, 2008

(65) Prior Publication Data

US 2008/0237406 A1 Oct. 2, 2008

(30) Foreign Application Priority Data

Mar. 27, 2007 (JP) ..... 2007-080453

(51) Int. Cl.
*G09G 5/00* (2006.01)

(52) U.S. Cl.
USPC ..... 345/2.1; 345/1.2

(58) Field of Classification Search
USPC ..... 345/1.1–2.3
See application file for complete search history.

(56) References Cited

U.S. PATENT DOCUMENTS 6,453,071 B2 * 9/2002 Ito et al. ..... 382/232
6,948,022 B2 * 9/2005 Ishibashi ..... 710/305
6,970,168 B2 * 11/2005 Emoto et al. ..... 345/440
7,391,317 B2 * 6/2008 Abraham et al. ..... 375/260
2006/0170285 A1 * 8/2006 Morimitsu et al. ..... 307/3

FOREIGN PATENT DOCUMENTS

JP 2002-209193 7/2002
JP 2004-203338 7/2004
JP 2005-057524 3/2005

OTHER PUBLICATIONS

Machine English Translation of JP 2002-209193 A, Translated date Mar. 9, 2011.*

* cited by examiner

*Primary Examiner* — Jimmy H Nguyen
(74) *Attorney, Agent, or Firm* — Antonelli, Terry, Stout & Kraus, LLP.

(57) ABSTRACT

A communication system in trains comprises a control data communication device 400 and an image data communication device 300 installed in each of the cars. The control data communication device 400 transmits train operation information, train location information, control instructions of train-mounted apparatuses, and the like. The image data communication device 300 transmits image information such as moving images and still images, audio information such as in-train announcement, textual information for caption display, and operation log information of apparatuses, which form the contents, to a display unit 200 installed in each of the cars and to apparatuses 500 such as a telephone. The display unit 200 switches the display on the screen in accordance with train control information transmitted from the control data communication device 400 through the image data communication device 300.

8 Claims, 9 Drawing Sheets

COMMUNICATION SYSTEM IN TRAINS

The present application is based on and claims propriety of Japanese patent application No. 2007-080453 filed on Mar. 27, 2007, the entire contents of which are hereby incorporated by reference.

BACKGROUND OF THE INVENTION

1. Field of the Invention

The present invention relates to a train communication system suitable for information communication in trains.

2. Description of the Related Art

In recent years, needs have grown for the passenger information services using a liquid crystal display and the like in trains, and technologies for delivering various service contents from a server installed in a train to display units and the like in each of the cars have become widely available.

In the conventional technology described in Japanese Patent Laid-Open Publication No. 2002-209193, a train information device that processes train information such as train operation information including stop station information, arrival time, and the like, train location information indicating kilometers from the starting station, and train-mounted apparatus information including door open-close instruction and the like is installed in each of the cars. The train information device of the lead car is connected to various control operation devices such as a master control unit, and the train information devices installed in the cars are connected to each other through a digital transmission path, working in concert with each other to input and output the various train information.

An image information delivery device installed in the lead car is connected to the train information device in the same car, and receives train information and outputs still image information. The still image information is outputted as digital data signals through a first transmission path connecting the train information devices, then goes through the train information device installed in each of the cars, and is transmitted to a receiver/display device installed in each of the cars. The image information delivery device is connected to the receiver/display device installed in each of the cars through a second transmission path connecting the image information delivery devices and transmits moving image information as analog data signals.

As for the still image information having a smaller data size compared to the moving picture information, high-resolution still image information is digitally transmitted by a packet system which has been conventionally used in the train information device. On the other hand, the moving picture information having a larger data size than the still image information is transmitted by an analog transmission system such as an NTSC system which has been conventionally used in a television set and the like, enabling a train-mounted image delivery display system that realizes moving images and high-quality still images at low cost. In addition, because a system is employed that transmits the moving image information and the still image information to the receiver/display device via different paths, even if abnormality occurs in either one of the transmission paths, image information by moving images or still-images can be continuously displayed using the normal transmission path, so that the reliability of the display function is improved.

However, in the conventional technology described in Japanese Patent Laid-Open Publication No. 2002-209193, when transmitting the moving picture information as analog data signals, a considerably wide communication frequency band is required to transmit high-quality images. Because a plurality of cars are connected in a train, signal degradation occurs even if, for example, the analog signals are amplified and relayed using an amplifier or the like. In addition, because electro-magnetic noise generated by an inverter or the like installed in a train is superimposed on the analog signals, delivery of high-quality images to each of the cars is difficult.

When delivering images by analog data signals, multi-channel communication in which a plurality of pieces of moving image information or audio lines of a telephone and the like are multiplexed is provided in one transmission path, so that further wider frequency band is required which is difficult to realize. In addition, disconnection of a transmission line between cars or failure of a communication device in a train prevents transmission of the moving image information or the still image information to the display unit such that the information cannot be displayed.

An object of the present invention is to easily realize transmission of high-quality moving image information and audio information by digital data signals, and to reduce the influence of disconnection of a transmission line or failure of a communication device, thereby providing a highly reliable communication system in trains.

SUMMARY OF THE INVENTION

In order to achieve the object, a communication system in trains according to the present invention transmits a plurality of image data from a server to a display unit through an image data communication device, stores the image data in the display unit, and controls the screen display of the plurality of image data stored in the display unit by using control information transmitted from a control data communication device through the image data communication device.

According to the present invention, moving image information, still image information, and the like that are converted into digital data are transmitted by the image data communication device, and the image data communication device and the server or the control data communication device are separated. Therefore, even when the image data communication device is unable to communicate due to failure or other reasons, train control information transmitted by the server or the control data communication device allows to change display on the screen using the plurality of image data prestored in the display unit, so that the reliability of the system is enhanced.

DETAILED DESCRIPTION OF THE PREFERRED EMBODIMENTS

Embodiments of a communication system in trains according to the present invention will now be described with reference to the drawings.

First Embodiment

Figure 1:
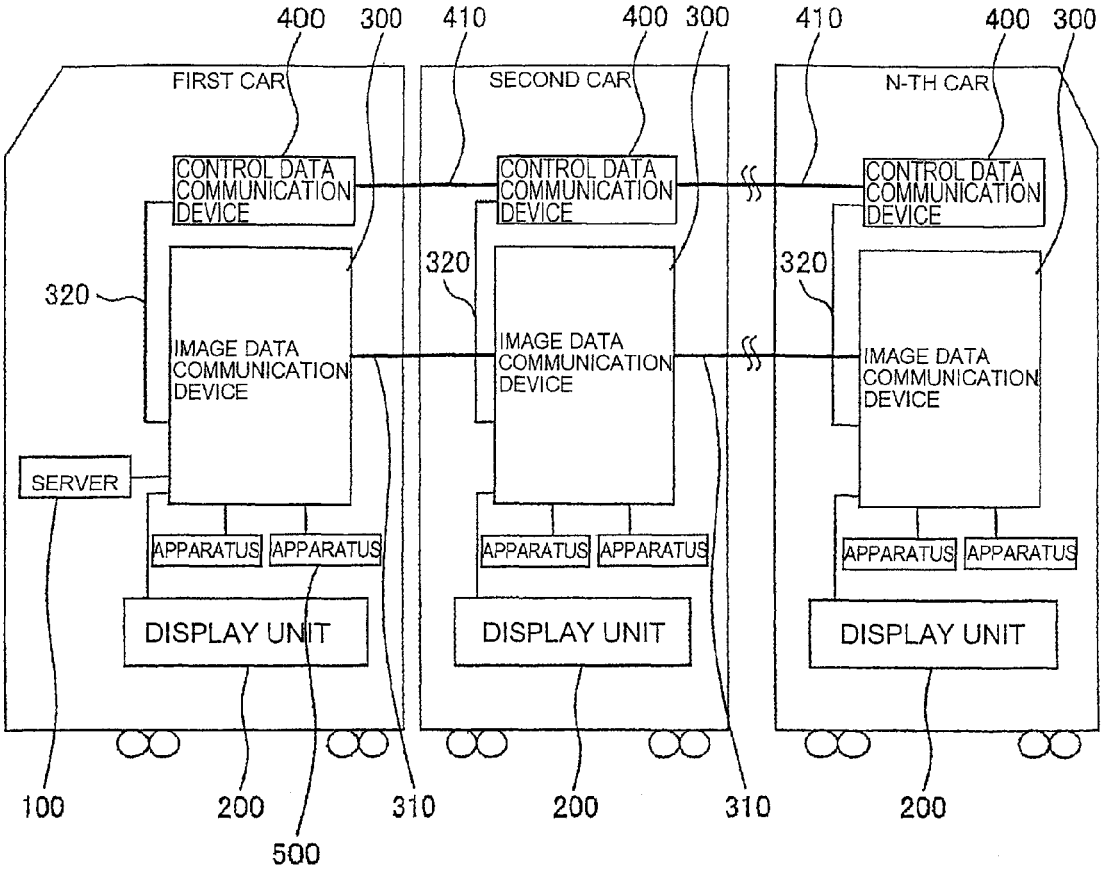
FIG. 1 is a block diagram of a communication system in trains of a first embodiment of the present invention.

A first embodiment of the present invention will be described with reference to FIGS. 1 to 6. FIG. 1 is a block diagram of the communication system in trains of the present embodiment.

As shown in FIG. 1, each car from the first car to n-th car is equipped with: a control data communication device 400 for transmitting train control information such as train operation information, train location information, and control instructions of train-mounted apparatuses; and an image data communication device 300 for transmitting image data such as moving image information and still image information converted into digital data. The control data communication device 400 and the image data communication device 300 are connected to each other by a transmission path 320. The control data communication devices 400 installed in the cars are connected in series by a transmission path 410, and the image data communication devices 300 installed in the cars are connected in series by the transmission path 310. Each image data communication device 300 is connected to a display unit 200 for displaying the image data through a transmission path and to a plurality of train-mounted apparatuses 500 such as a telephone and an air conditioner. Each image data communication device 300 transmits image information such as moving images and still images, audio information such as in-train announcement, textual information for caption display, and operation log information of apparatuses, which form the contents. Ethernet (registered trademark) or the like is used as an interface for connection, for example.

A server 100 is installed in the first car and is connected to the image data communication device 300. The image data such as moving image information and still image information for transmission by the image data communication device 300, audio data for audio announcement, and other data are recorded in the server 100. The image data and audio data are transmitted to each of the cars using the image data communication device 300. As in other apparatuses, Ethernet or the like is used as an interface between the server 100 and the image data communication device 300.

A plurality of image data are transmitted from the server 100 to the display unit 200 using the image data communication device 300 and stored in the display unit 200. The display unit 200 displays one of the plurality of stored image data on the screen of the display unit in accordance with the train control information indicative of display timing transmitted by the control data communication device 400. Incidentally, more than one car may be equipped with the server 100.

The image data communication device 300 can transmit not only the image data, but also data such as audio information for in-train announcement, textual information for caption display, or operation log information of train-mounted apparatuses, as long as the data is digitized.

The control data communication device 400 is installed in need of transmitting the train operation information indicating a stop station and the like, the train location information indicating a travel distance from the starting point, and instruction information for controlling opening and closing of the door and the like, thereby conducting the highly reliable communication for realizing safe operation of the train. The control data communication device 400 is installed in an existing train and a new train as a communication device that conducts communication of the control data of train-mounted apparatuses with priority over the data such as the image data or the like that is not directly related to the train operation. In addition, the control data communication device 400 and the image data communication device 300 are provided separately.

Figure 2:
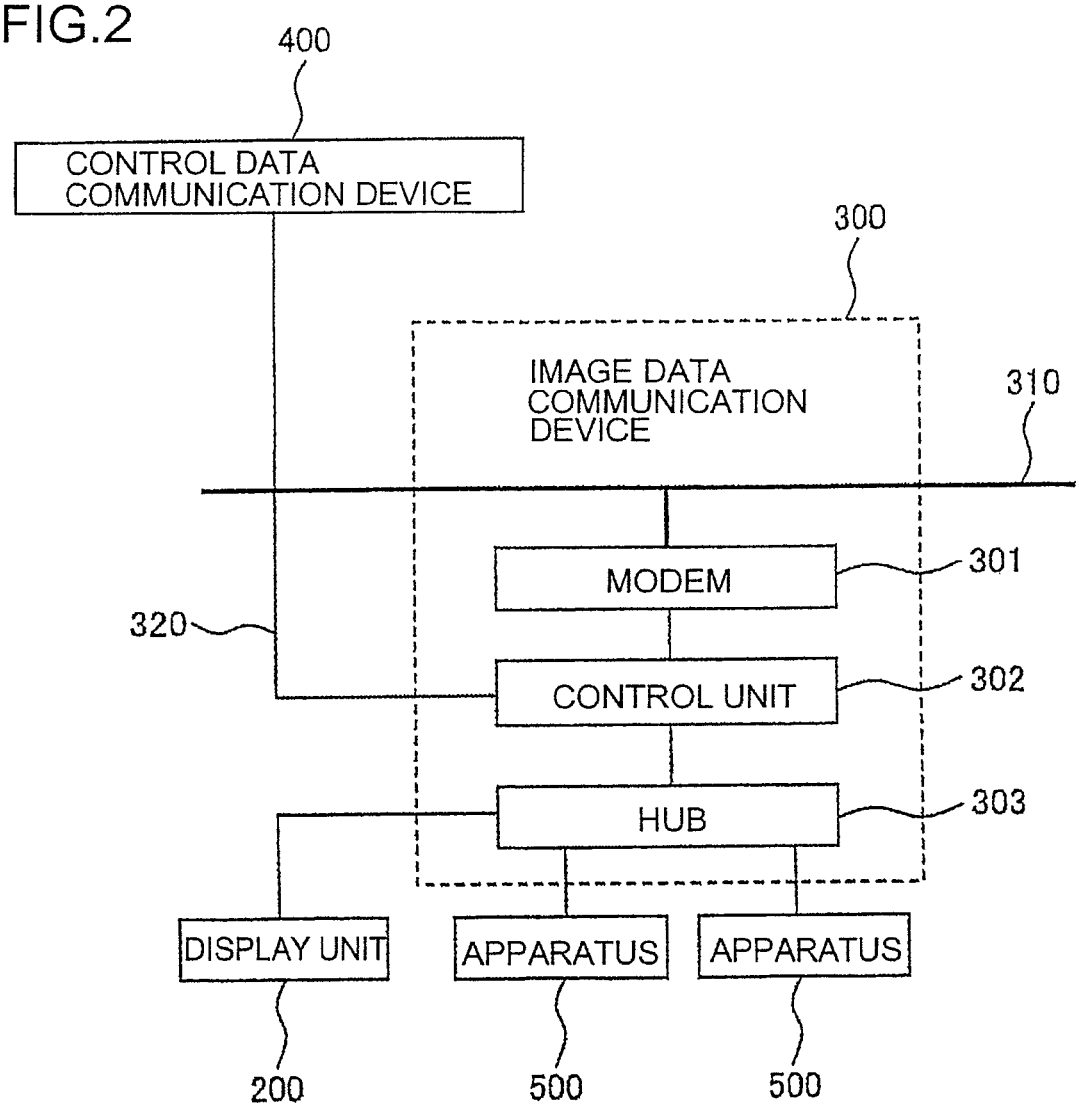
FIG. 2 is a block diagram of an image data communication device.

As shown in FIG. 2, the image data communication device 300 comprises a modem 301 connected to the transmission path 310, a control unit 302 connected to the control data communication device 400 through the transmission path 320, and a hub 303 connected to the control unit 302. The hub 303 is connected to the display unit 200 and the plurality of train-mounted apparatuses 500, and can communicate according to the Ethernet protocol.

The control unit 302, of the image data communication device 300, connected to the control data communication device 400 through the transmission path 320 controls the modem 301 and the hub 303 to conduct data communication. Installation of the control unit 302 enables to control the packet transmission process in the hub 303.

The transmission path 310 is branched in the image data communication device 300 and is connected to the modem 301. Between the image data communication devices 300, communication is conducted in the multi-drop system in which one transmission path is shared. As an access system for executing the multi-drop system, a polling system, a CSMA/CA (Carrier Sense Multiple Access/Collision Avoidance) system, or the like is employed.

When communicating in the multi-drop system, a wiring method of the transmission path 310 includes a method in which the transmission path 310 is branched outside the image data communication device 300 and connected at one point. In this case, the branch line length of the transmission path 310 depends heavily on the installation locations of the image data communication device 300 in the train and the branch point, so that the communication performance in the modem 301 may be greatly deteriorated. Therefore, in the present embodiment, as shown in FIG. 2, the transmission path 310 is branched inside the image data communication device 300. This method can improve the communication performance.

The control data communication device 400 is connected to the image data communication device 300 by an interface, such as RS-485, RS-232C, or TTL, that can be interconnected with the image data communication device 300. If they can mutually communicate, addition of the image data communication device 300 to the control data communication device 400 installed in an existing train or to the control data communication device 400 newly installed in a new train enables to easily establish the communication system in trains, and the cost for establishing the system can be reduced.

Figure 3:
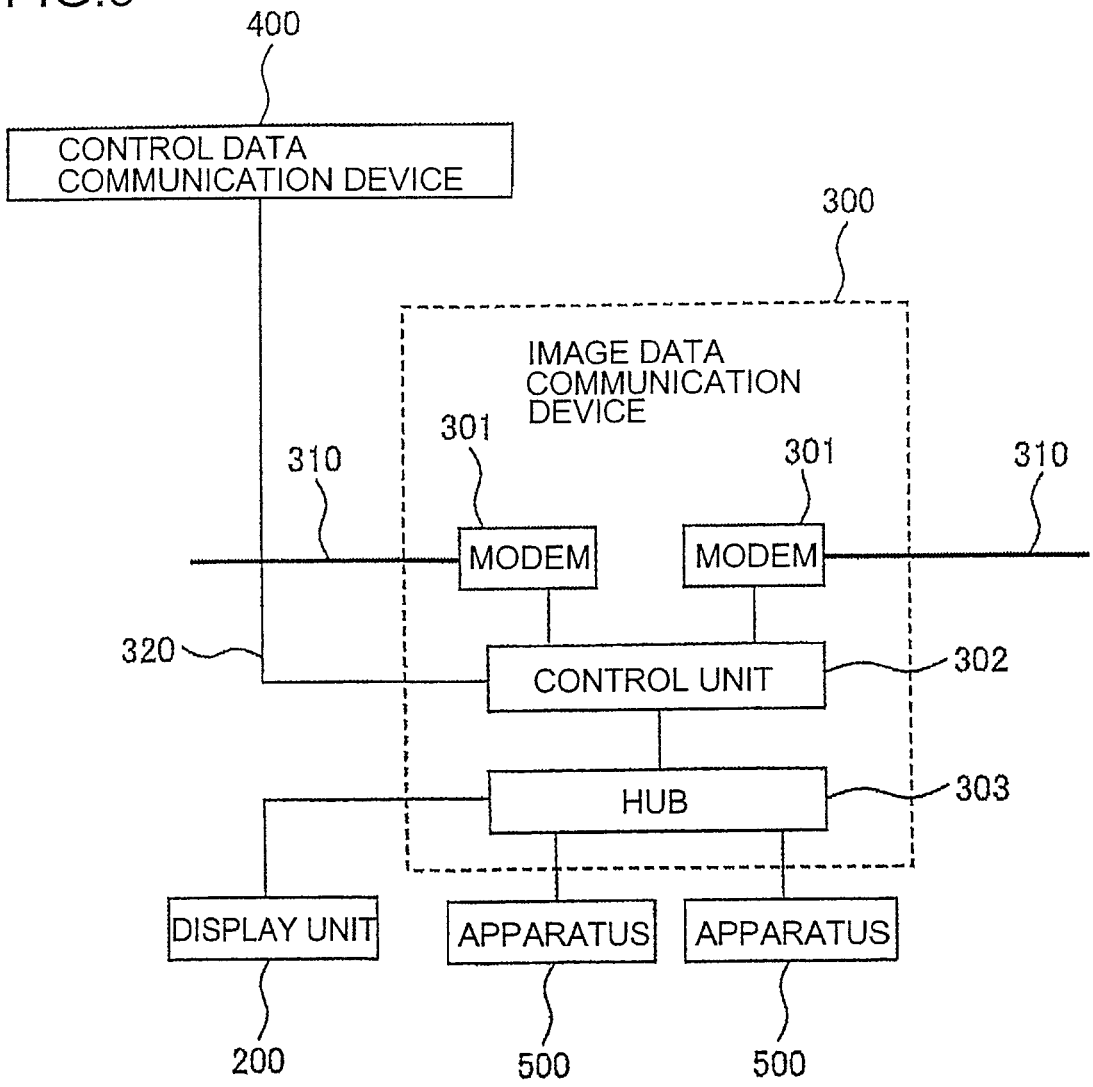
FIG. 3 is another block diagram of the image data communication device.

An example of the connection method of the transmission path 310 and the image data communication device 300 includes, as shown in FIG. 3, a method of dividing the transmission path 310 inside the image data communication device 300 and connecting both of the divided transmission paths 310 to the modems 301. In this example, the system is such that two modems 301 are provided and connected to the divided transmission paths 310 respectively, and 1:1 communication is conducted with other adjacent image data communication devices 300. Because this system employs the 1:1 communication, the transmission path 310 communicates with adjacent image data communication devices 300, allowing communication with image data communication devices 300 in other cars and enhancing the flexibility of communication process of the image data communication device 300.

Figure 4:
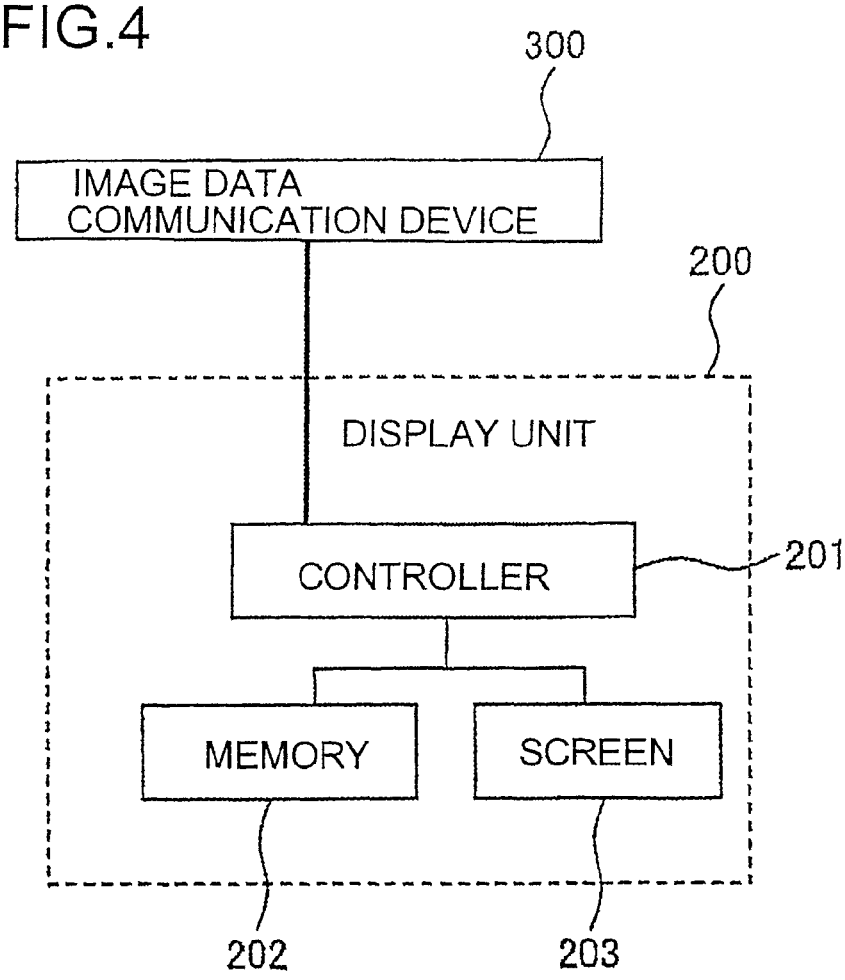
FIG. 4 is a block diagram of a display unit.

As shown in FIG. 4, the display unit 200 comprises a controller 201 connected to the image data communication device 300, and a memory 202 and a screen 203 both connected to the controller 201. The controller 201 receives the control information to control input and output signals to and from the display unit 200, and the memory 202 is installed for recording the input and output signals of the controller 201. In accordance with an instruction of the controller 201, the screen 203 displays image data of moving images or still images stored in the memory 202 and textual information for caption display.

The display unit 200 communicates with the image data communication device 300 in accordance with the Ethernet protocol, for example. Using the image data communication device 300, a plurality of image data are transmitted from the server 100 to the memory 202 of the display unit 200 and stored in the memory 202. In the display unit 200, the controller 201 displays either the plurality of image data or the textual information for caption display that are stored in the memory 202 onto the screen 203, in accordance with the control data transmitted by the control data communication device 400.

Figure 5:
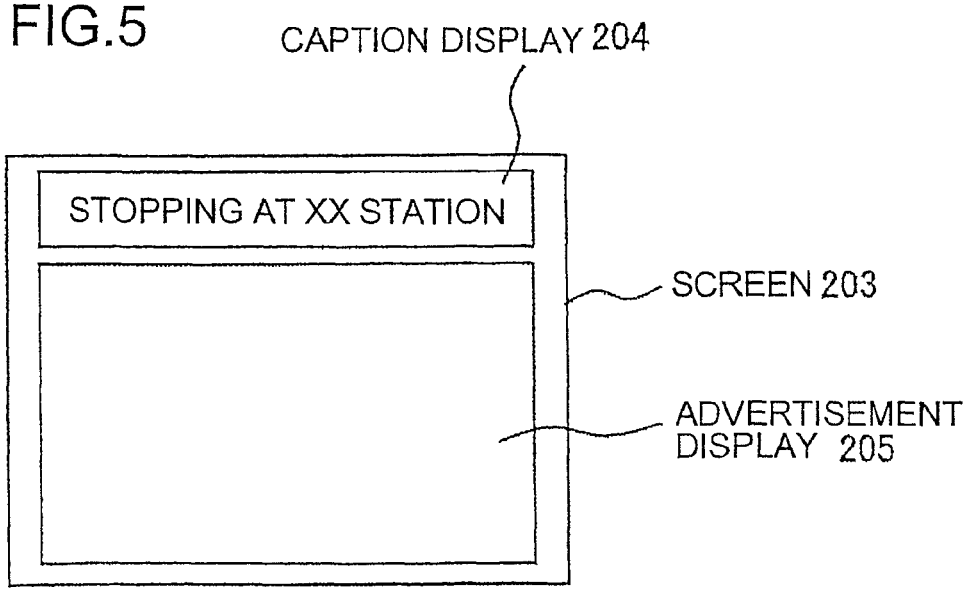
FIG. 5 depicts an example of a screen display.

One example of display of the screen 203 of the display unit 200 is illustrated in FIG. 5. Textual information corresponding to a caption display part 204 is displayed on the upper part of the screen 203, and moving image information or still image information corresponding to an advertisement display part 205 is displayed on the lower part of the screen 203. As described, because a plurality of pieces of image information and textual information are stored in the memory 202, a plurality of kinds of image information and textual information can be displayed within one screen 203 by the control of the controller 201.

Figure 6:
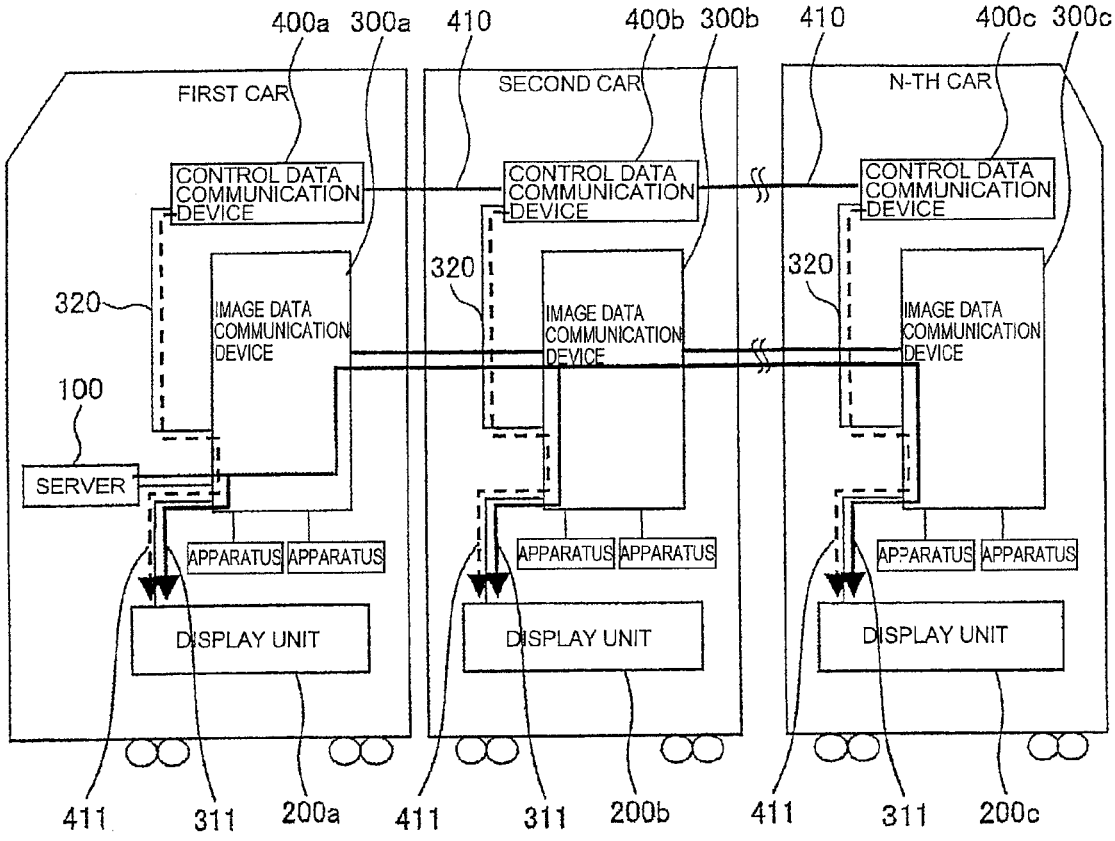
FIG. 6 depicts flows of data of the communication system in trains of the present embodiment.

FIG. 6 depicts flows of image data 311 for display on the display unit 200 and image display timing information 411 in the communication system in trains of the present embodiment. During normal operation, the image data 311 is transmitted from the server 100 to the display unit 200 of each of the cars through the image data communication device 300. The image data 311 transmitted to the display unit 200 of each of the cars is at times the same information, and at other times, different information. Therefore, in the control unit 302 and the hub 303 installed in the image data communication device 300, the address of the packets including the image data 311 is checked and the transmission direction is determined.

The timing information 411 for image display is transmitted from the control data communication device 400 to the display unit 200 through the image data communication device 300. The timing information 411 includes kilometers indicating the travel distance from the starting point, passed station names, time information, or the like.

If the image data communication device 300*b* has failed, communication cannot be conducted between the image data communication device 300*a* and the image data communication device 300*c*, so that the new image data 311 cannot be transmitted from the server 100 to the display unit 200*c*. However, because the plurality of image data are already stored in the memory 202 of the display unit 200, the screen 203 of the display unit 200*c* can be switched by obtaining the timing information 411 from the control data communication device 400*c*.

As described, according to the present embodiment, the plurality of pieces of moving image information, audio information, textual information, log information of train-mounted apparatuses, and the like are converted into digital data signals to conduct multiplexed communication with one channel, allowing high-quality moving image transmission and audio transmission to each of the cars. Transmission by digital data signals in combination with an error correction coding technology and a retransmission technology enables to establish a highly reliable system.

Second Embodiment

Figure 7:
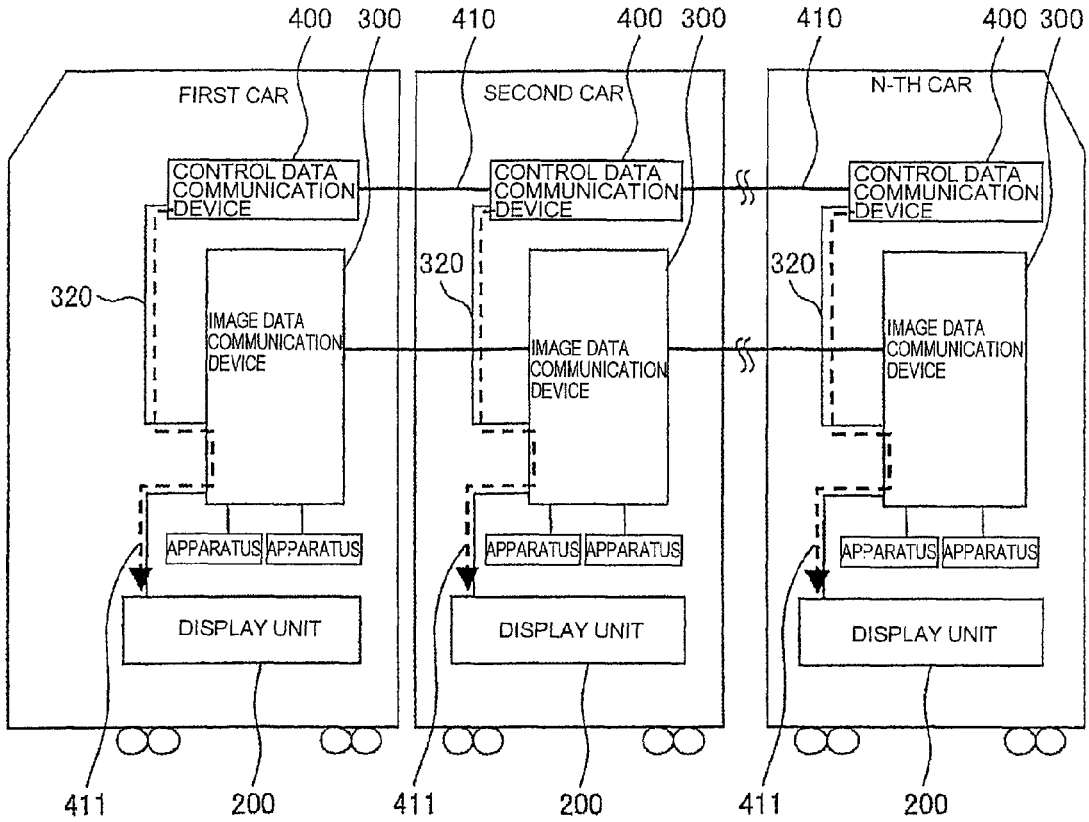
FIG. 7 is a block diagram of the communication system in trains of a second embodiment of the present invention.

A second embodiment of the present invention will be described with reference to FIG. 7. FIG. 7 is a block diagram of the communication system in trains of the present embodiment. Although the basic configuration is the same as in the first embodiment shown in FIG. 1, in the present embodiment, the server 100 is not installed in the first car. Thus, the image data and the like cannot be transmitted from the server 100 to the display unit 200 of each of the cars through the image data communication device 300. However, storing in advance the plurality of image data, textual data, and the like in the memory 202 of the display unit 200 and transmitting the control information 411 indicative of display timing from the control data communication device 400 through the image data communication device 300 allow to change the display of the screen 203 of the display unit 200.

Third Embodiment

Figure 8:
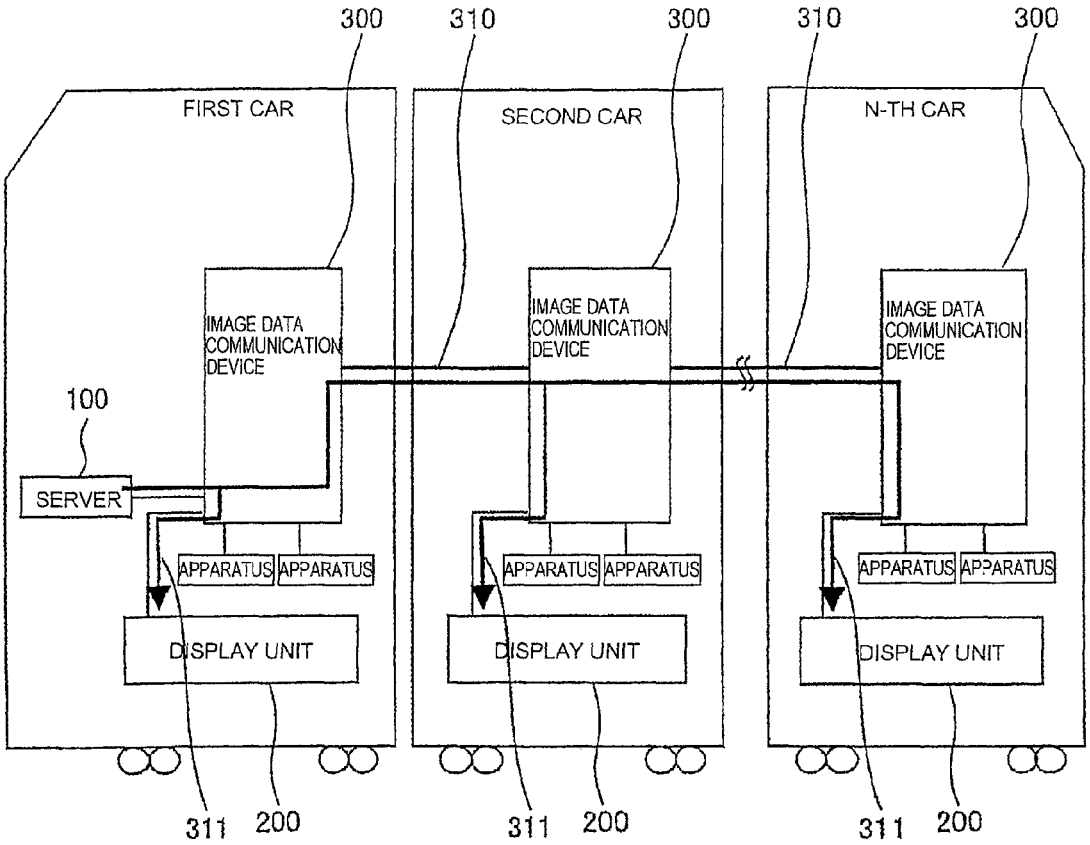
FIG. 8 is a block diagram of the communication system in trains of a third embodiment of the present invention.

A third embodiment of the present invention will be described with reference to FIG. 8. FIG. 8 is a block diagram of the communication system in trains of the present embodiment. Although the basic configuration is the same as in the first embodiment shown in FIG. 1, the control data communication device 400 is not installed in each of the cars in the present embodiment. Thus, the control information 411 indicative of the display timing cannot be transmitted from the control data communication device 400 to the display unit 200 of each of the cars through the image data communication device 300. However, transmitting the control information indicative of the display timing together with the image data 311 from the server 100 through the image data communication device 300 allows to change the display of the screen 203 of the display unit 200.

Fourth Embodiment

Figure 9:
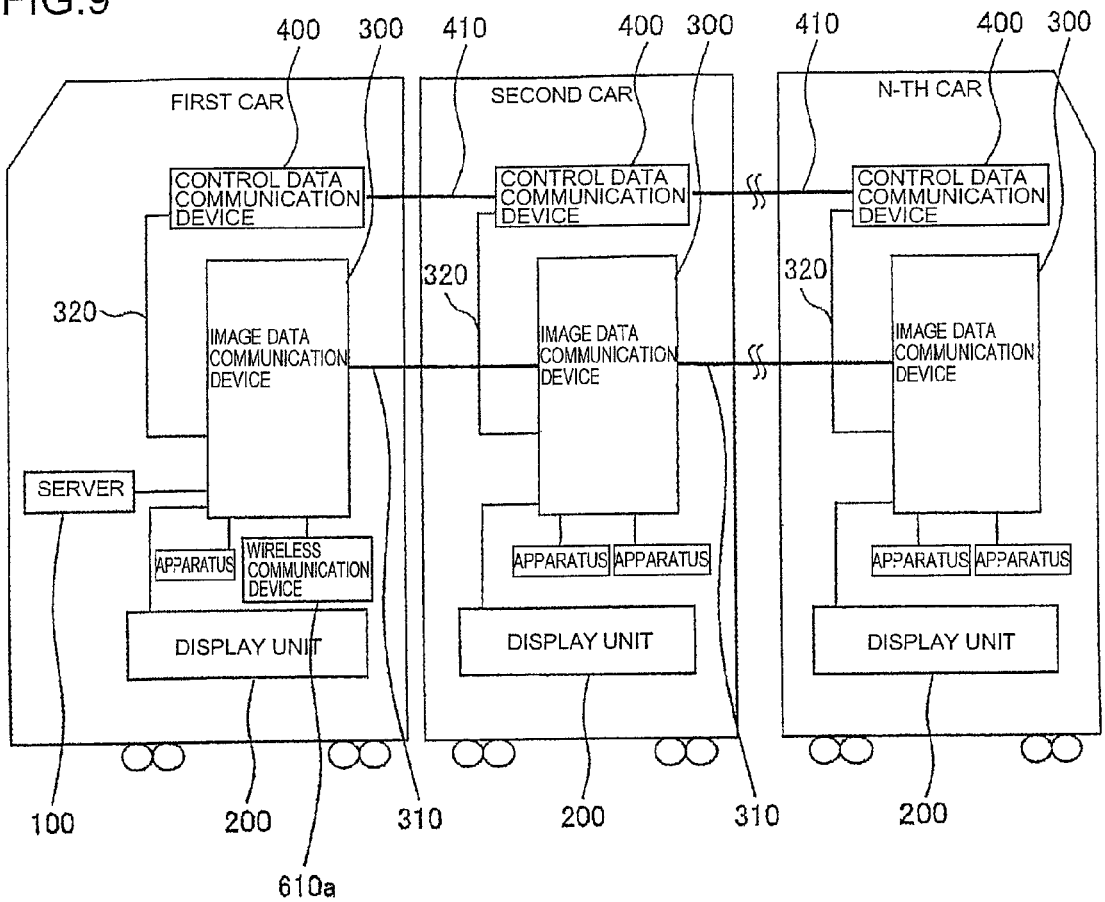
FIG. 9 is a block diagram of the communication system in trains of a fourth embodiment of the present invention.
Figure 9:
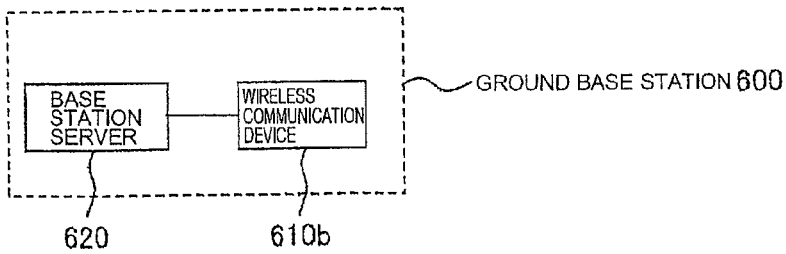

A fourth embodiment of the present invention will be described with reference to FIG. 9. FIG. 9 is a block diagram of the communication system in trains of the present embodiment. Although the basic configuration is the same as in the first embodiment shown in FIG. 1, in the present embodiment, a wireless communication device 610*a* is installed in the first car, and the wireless communication device 610*a* is connected to the image data communication device 300.

The wireless communication device 610*a* transmits data such as new moving image information, still image information, audio information, and textual information from a base station server 620 in a ground base station 600 placed on the ground through a wireless communication device 610*b*, thereby allowing to change the display of the screen 203 of the display unit 200.

In the communication system in trains described in the first embodiment, the wireless communication device 610*a* may be installed in the first car, and the wireless communication device 610*a* may be connected to the image data communication device 300.

Fifth Embodiment

Figure 10:
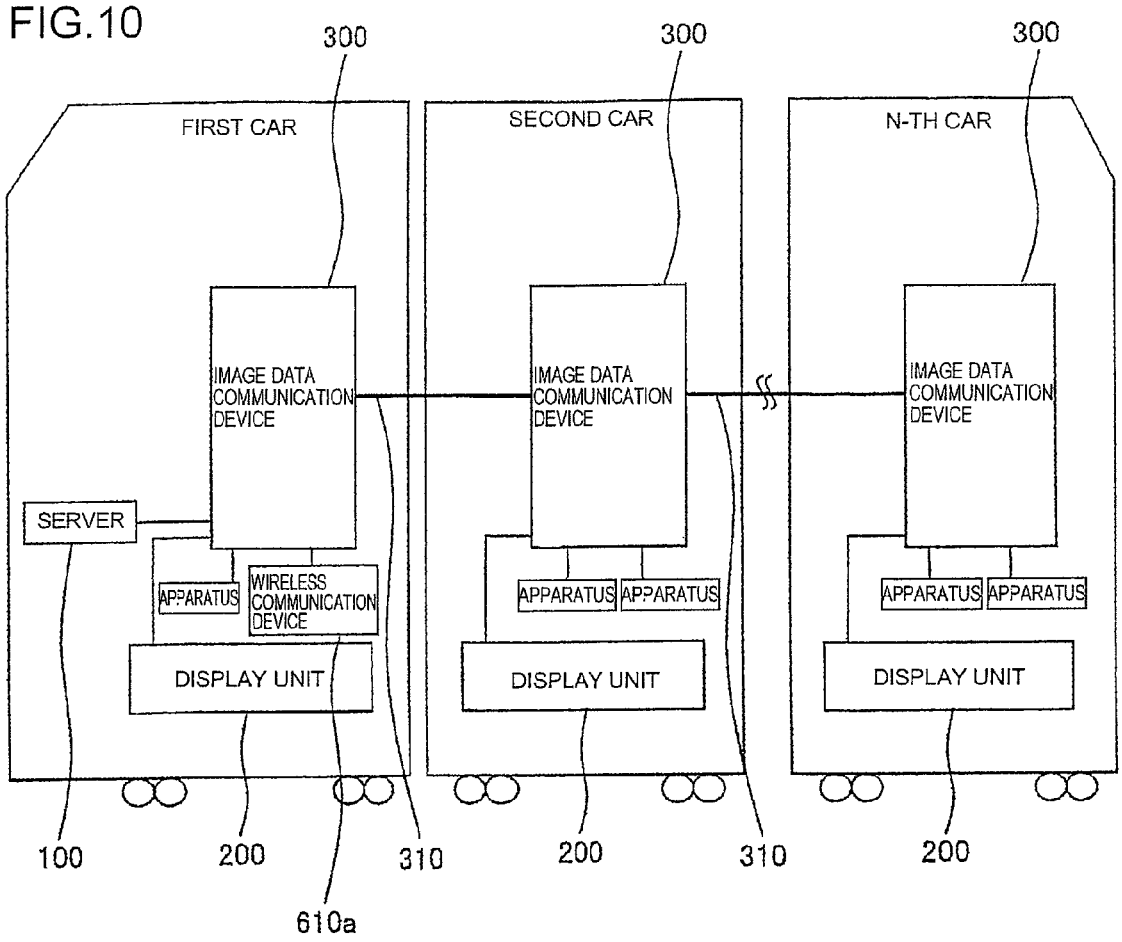
FIG. 10 is a block diagram of the communication system in trains of a fifth embodiment of the present invention.
Figure 10:
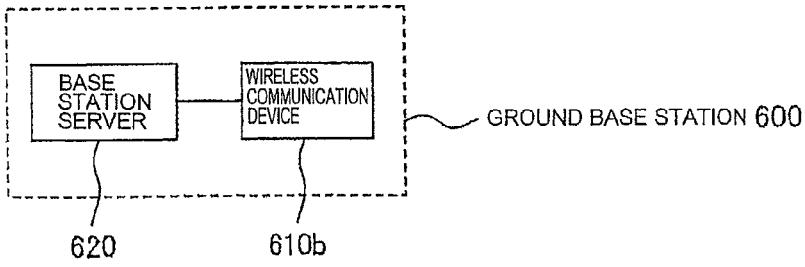

A fifth embodiment of the present embodiment will be described with reference to FIG. 10. FIG. 10 is a block diagram of the communication system in trains of the present embodiment. Although the basic configuration is the same as in the fourth embodiment shown in FIG. 9, the control data communication device 400 installed in each of the cars in the fourth embodiment is not installed in the present embodiment. Therefore, the control information 411 indicative of the display timing cannot be transmitted from the control data communication device 400 to the display unit 200 of each of the cars through the image data communication device 300.

However, the wireless communication device 610*a* installed in the first car is connected to the image data communication device 300. Thus, the wireless communication device 610*a* can transmit data such as new moving image information, still image information, audio information, and textual information from the base station server 620 in the ground base station 600 placed on the ground through the wireless communication device 610*b*, and can transmit the control information indicative of the display timing together with the image data 311 from the server 100 through the image data communication device 300, thereby allowing to change the display of the screen 203 of the display unit 200.

As described, the communication device in trains of the embodiments transmits the plurality of image data, textual information for caption display, and the like from the server 100 to the display unit 200 through the image data communication device 300 and transmits the timing information from the server 100 or the control data communication device 400 to the display unit 200 through the image data communication device 300, enabling to establish a highly reliable communication system in trains whose display on the screen of the display unit 200 can be switched, even when the image data communication device 300 has failed.

What is claimed is:

1. A communication system in a train, comprising:

a plurality of cars, connected to form the train, each car having installed therein:

a control data communication device, an image data communication device, and a display unit;

wherein the train includes the plurality of control data communication devices, the plurality of image data communication devices, and the plurality of display units;

wherein each image data communication device includes:

a modem configured to modulate image data, the modem connected inside the image data communication device to a line branched from an image transmission path connecting image data communication devices from car to car, a hub connected to a plurality of train-mounted apparatuses including the display unit, and a control unit configured to control the modem and the hub, the control unit connected to the control data communication device in the same car by a first transmission path, and the control unit connected to another control unit in an adjacent car through the modem in the same car;

wherein each display unit includes:

a memory configured to store the image data, a screen configured to display the image data, and a controller configured to control the screen, so as to display any image data stored in the memory in accordance with train control information transmitted from the control data communication device through the image data communication device;

wherein each control data communication device is connected by a control transmission path to a control data communication device in an adjacent car, so as to transmit and/or receive train control information between connected control data communication devices in adjacent cars; and wherein each image data communication device is:

connected by the image transmission path to an image data communication device in an adjacent car, so as to transmit and/or receive image data between image data communication devices in adjacent cars, connected by the first transmission path to the control data communication device in a same car, so as to receive train control information from the control data communication device in the same car via the first transmission path, and directly connected by a second transmission path to the display unit in the same car, so as to directly transmit image data and train control information from the image data communication device to the display unit in the same car, via the second transmission path.

2. The communication system in trains according to claim 1, wherein the image transmission path connecting image data communication devices from car to car is connected to a plurality of modems, and wherein each of the plurality of modems is connected to a respective control unit.

3. The communication system in trains according to claim 1, wherein the controller of the display unit is configured to receive train control information, and to control display timing of image data stored in the memory of the display unit.

4. The communication system in trains according to claim 1, wherein the image data is in a digital format, and the image data includes both still image data and moving image data.

5. The communication system in trains according to claim 1, further comprising:

a server provided in one of the cars, the server being configured to transmit image data to the image data communication device, through the image transmission path.

6. The communication system in trains according to claim 5, further comprising:

a wireless communication device provided in one of the cars, and configured to communicate with a ground base station server placed on the ground.

7. The communication system in trains according to claim 6, wherein the wireless communication device communicates data between the ground base station server placed on the ground, and the server installed in the car.

8. The communication system in trains according to claim 1, wherein when there is a failure of image data communication in a car, the control unit in the car communicates with the display unit in the car, by the first transmission path, and the display unit in the car displays stored image data.

* * * * *